US011486083B2

(12) United States Patent
Doyle

(10) Patent No.: US 11,486,083 B2
(45) Date of Patent: Nov. 1, 2022

(54) SOCK-PAIR JOINING DEVICE

(71) Applicant: Gabriela Doyle, Nogales, AZ (US)

(72) Inventor: Gabriela Doyle, Nogales, AZ (US)

( * ) Notice: Subject to any disclaimer, the term of this patent is extended or adjusted under 35 U.S.C. 154(b) by 0 days.

(21) Appl. No.: 17/373,562

(22) Filed: Jul. 12, 2021

(65) Prior Publication Data

US 2022/0087461 A1 Mar. 24, 2022

Related U.S. Application Data

(63) Continuation-in-part of application No. 29/652,568, filed on Sep. 22, 2020.

(51) Int. Cl.
*D06F 89/00* (2006.01)
*A47G 25/00* (2006.01)
*A41B 11/00* (2006.01)

(52) U.S. Cl.
CPC ..... *D06F 89/005* (2013.01); *A41B 11/002* (2013.01); *A47G 25/00* (2013.01)

(58) Field of Classification Search
CPC ..... A47G 25/00; A47G 25/005; D06F 59/06; D06F 89/005; A41B 11/002
USPC ..... 223/37, 38, 75, 78; 211/33, 37; 248/125.8
See application file for complete search history.

(56) References Cited

U.S. PATENT DOCUMENTS 192,826 A * 7/1877 Hart ..... A47F 7/06 211/33
402,137 A * 4/1889 Bryant ..... F26B 21/006 34/104
D44,400 S * 7/1913 Correll ..... 211/37
1,281,927 A * 10/1918 Felton ..... F26B 21/006 34/104
1,501,258 A * 7/1924 Wolfe ..... A47F 5/06 248/185.1
1,723,058 A * 8/1929 Napier ..... A47F 7/10 223/75
2,255,836 A * 9/1941 Vaughan ..... A41B 11/00 223/76
2,707,566 A * 5/1955 Eaton ..... A47F 7/10 211/205
2,849,167 A * 8/1958 Walser, Jr. ..... D06G 3/02 223/39
2,936,529 A * 5/1960 Flanagan ..... D06C 5/005 34/103
3,318,141 A * 5/1967 Woodfin ..... D06H 3/16 73/833
3,319,849 A * 5/1967 Horberg, Jr. ..... D06C 5/005 414/618

(Continued)

FOREIGN PATENT DOCUMENTS

CN 104562590 A * 4/2015 ..... D06F 57/08
CN 110541289 A * 12/2019 ..... D06F 57/08

(Continued)

*Primary Examiner* — Michael Safavi

(74) *Attorney, Agent, or Firm* — Eugene Vamos

(57) ABSTRACT

The Sock Joining Device (200) provides for an efficient way to place sock-pairs (150) into a joined state that is pleasing to the eye, that remain in this joined state and specifically takes into account socks (100) with a heel section (110). The Sock Joining Device (200) comprises a volume (300), a pole (400). The Sock Joining Device (200) may further comprise a means for holding upright the pole (500).

5 Claims, 9 Drawing Sheets

(56) References Cited

U.S. PATENT DOCUMENTS 4,421,258 A * 12/1983 Safrit ..... D06H 3/16 223/75
4,592,473 A * 6/1986 Efrom ..... D06F 57/00 211/205
4,624,375 A * 11/1986 Strongosky ..... A47F 7/10 223/75
4,807,837 A * 2/1989 Gawlik ..... F16M 11/22 211/196
5,788,130 A * 8/1998 Todd ..... B65B 63/045 493/444
6,085,436 A * 7/2000 Peet ..... D06F 59/04 34/106
7,699,194 B2 * 4/2010 Cortese ..... D06C 5/005 223/75
8,950,591 B1 * 2/2015 McDowell ..... A45D 44/14 211/13.1
2002/0179652 A1 * 12/2002 Manini ..... D06C 5/005 223/75
2004/0020263 A1 * 2/2004 Brunk ..... G01N 3/56 73/9
2004/0108343 A1 * 6/2004 Bagni ..... D06C 5/005 223/75
2011/0139835 A1 * 6/2011 Fikes ..... A47G 25/905 223/111
2013/0284771 A1 * 10/2013 Fikes ..... A47G 25/905 223/111
2016/0374416 A1 * 12/2016 Wong ..... A41D 19/043 223/78
2021/0113005 A1 * 4/2021 Patay ..... A47G 29/087
2021/0169047 A1 * 6/2021 Ray Christian ..... A01K 13/007

FOREIGN PATENT DOCUMENTS

DE 19708122 C1 * 4/1998 ..... B65B 63/04
GB 2168156 A * 6/1986 ..... D06H 3/16
KR 20130071940 A * 7/2013 ..... D06F 57/08
KR 20140016093 A * 2/2014 ..... D06F 59/06
WO WO-2011088498 A1 * 7/2011 ..... D06F 57/04

* cited by examiner

SOCK-PAIR JOINING DEVICE

CROSS-REFERENCE TO RELATED APPLICATIONS

The present application is a continuation in part application of U.S. non-provisional Design Patent Application Ser. No. 29/652,568 filed on Sep. 22, 2020

SEQUENCE LISTING

Not Applicable

STATEMENT REGARDING FEDERALLY SPONSORED RESEARCH/DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM

Not Applicable

STATEMENT REGARDING PRIOR DISCLOSURES BY AN INVENTOR OR JOINT INVENTOR

Not Applicable

BACKGROUND OF THE INVENTION

1 Field of Invention

The Sock Joining Device is a household device that aids in the sock joining and organizing process.

2 Prior Art

The art of sock-pair joining is as old as the invention of the sock (100). A sock (100) comprises a cuff (110), a leg section (120), and a toe section (140). A sock (100) may also comprise a heel section (130), creating an angled profile between the leg section (120) and the toe section (140). Socks (100) with a heel section (130) form a more natural fit around a person's heel. FIG. 8 shows the structural features of a sock (100) comprising a heel section (130). Many modern socks are formed with a heel angle of around 120 degrees. Socks (100) exist with other heel angles such as 90 degrees and 100 degrees.

A number of sock joining techniques have been developed to organize sock-pairs. These include the square method, the single-fold method, the roll method, the military method, the fold and tuck method, and the flip and tuck method, among others. See generally https://goldiesocks.com/blogs/news/6-ways-to-fold-socks However, all these techniques are time consuming and inefficient when applied to more than just a few socks-pairs. Some of these techniques create unsightly sock-pairs and some of the techniques join sock-pairs that come apart easily. These shortcomings defeat the organizational goal of matching and joining sock-pairs.

These sock joining techniques are not particularly suited for socks (100) further comprising a heel section (130), resulting in extra work or creating unsightly joined sock-pairs.

There is a need for a device that: a) increases sock joining throughput and b) takes into account socks (100) with heel sections (130).

BRIEF SUMMARY OF THE INVENTION

The Sock Joining Device (200) allows for an efficient method to join sock-pairs (150) of all types, including but not limited to short, long, heel, no heel, adult and infant socks. In particular the Sock Joining Device (200) takes into account socks (100) with a heel section (130) ("heel socks"). The joined sock-pairs are pleasing to the eye and remain in a joined state.

The Sock Joining Device (200) comprises a volume (300), and a pole (400). The Sock Joining Device may further comprise a means for holding upright the pole (500).

The volume (300) provides the structure through which the cuff (120) of the sock (100) is inserted. The volume (300) comprises a first end (310), a second end (320) and a central axis (390).

The pole (400) provides support to the volume (300). The pole (400) is connected to the first end (310) of the volume (300).

The means for holding upright the pole (500) provides upright support to the pole (400) and supports the Sock Joining Device (200) as socks (100) are inserted through the volume (300).

The cuff (110) of a sock (100) is inserted through the second end (320) of the volume (300), moved over the first end (310) of the volume (300), and then moved over the pole (400).

DETAILED DESCRIPTION OF THE INVENTION

Figure 1:
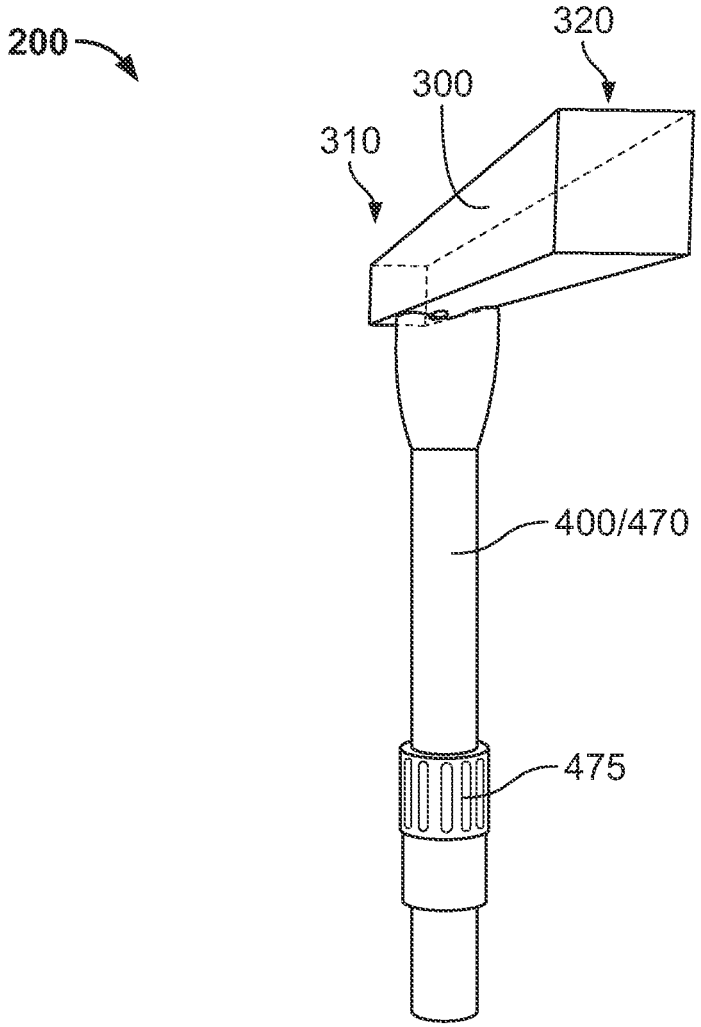
FIG. 1 shows a perspective view of the Sock Joining Device (200), with a volume (300) joined to a telescoping pole (470), the volume (300) in the shape of a trapezoidal prism.

The Sock Joining Device (200) allows for an efficient method to join sock-pairs (150) of all types, including but not limited to short, long, heel, no heel, adult and infant socks. In particular the Sock Joining Device (200) takes into account socks (100) with a heel section (130) ("heel socks"). The joined sock-pairs are pleasing to the eye and remain in a joined state.

The Sock Joining Device (200) comprises a volume (300), and a pole (400). The Sock Joining Device may further comprise a means for holding upright the pole (500).

1 Volume (300)

The volume (300) provides the structure over which the cuff (120) of the sock (100) is inserted. The volume (300) comprises a first end (310), a second end (320) and a central axis (390).

Figure 3:
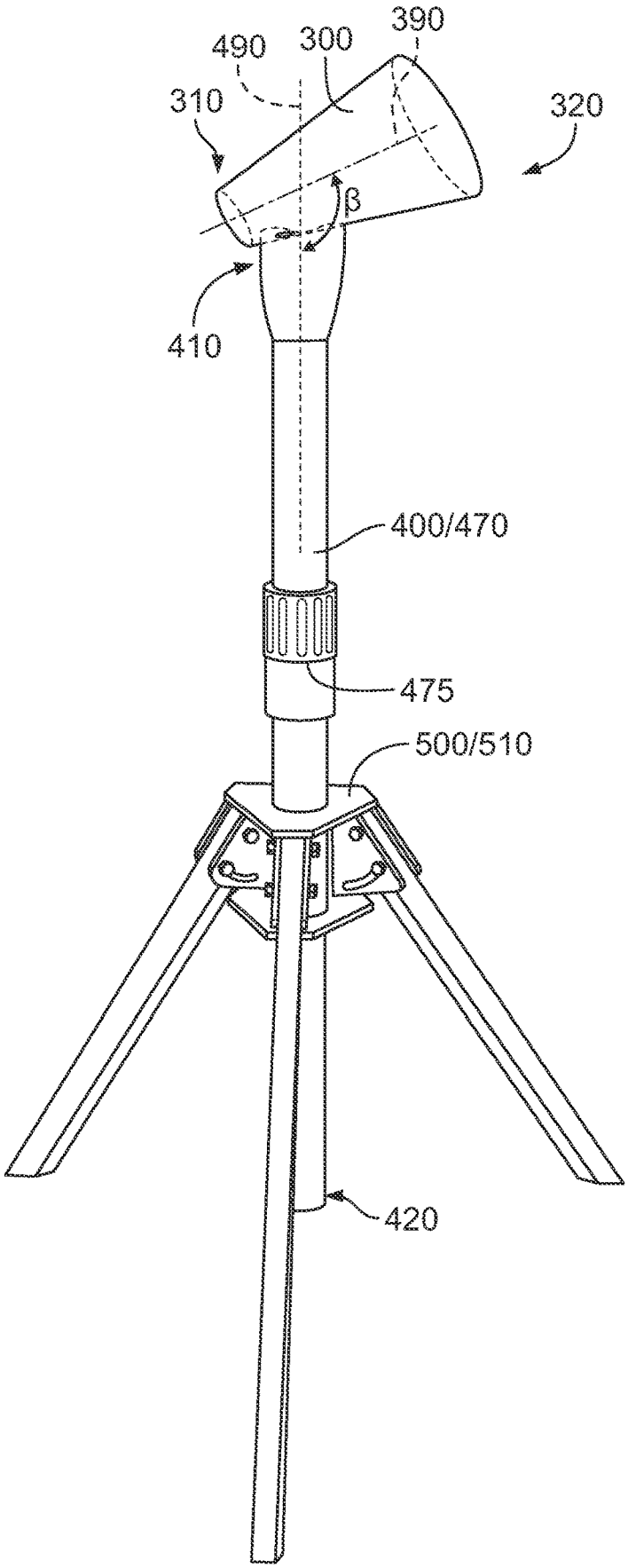
FIG. 3 shows a perspective view of the Sock Joining Device (200), with a volume (300) joined to a telescoping pole (470), the volume (300) in the shape of a frustrum.

The volume (300) tapers from the second end (320) of the volume (300) towards the first end (310) of the volume (300). Example volume shapes that taper from a second end towards a first end include but are not limited to geometrical shapes such as cones, rectangular pyramids, triangular pyramids, trapezoidal prisms, and frustrums. FIG. 1 shows a volume (300) in the shape of an irregular square frustrum. FIG. 3 shows a volume (300) in the shape of a conical frustrum.

The tapering of the volume (300) serves one primary function. As the cuff (120) of the sock (100) is pushed through the second end (320) of the volume (300), the second end (320) of the volume (300) provides friction resistance against the inside surface of the sock (100). This friction resistance prevents an inserted first sock (100*a*) from moving as a second sock (100*b*) is inserted over the first sock (100*a*) and the volume (300).

Figure 5:
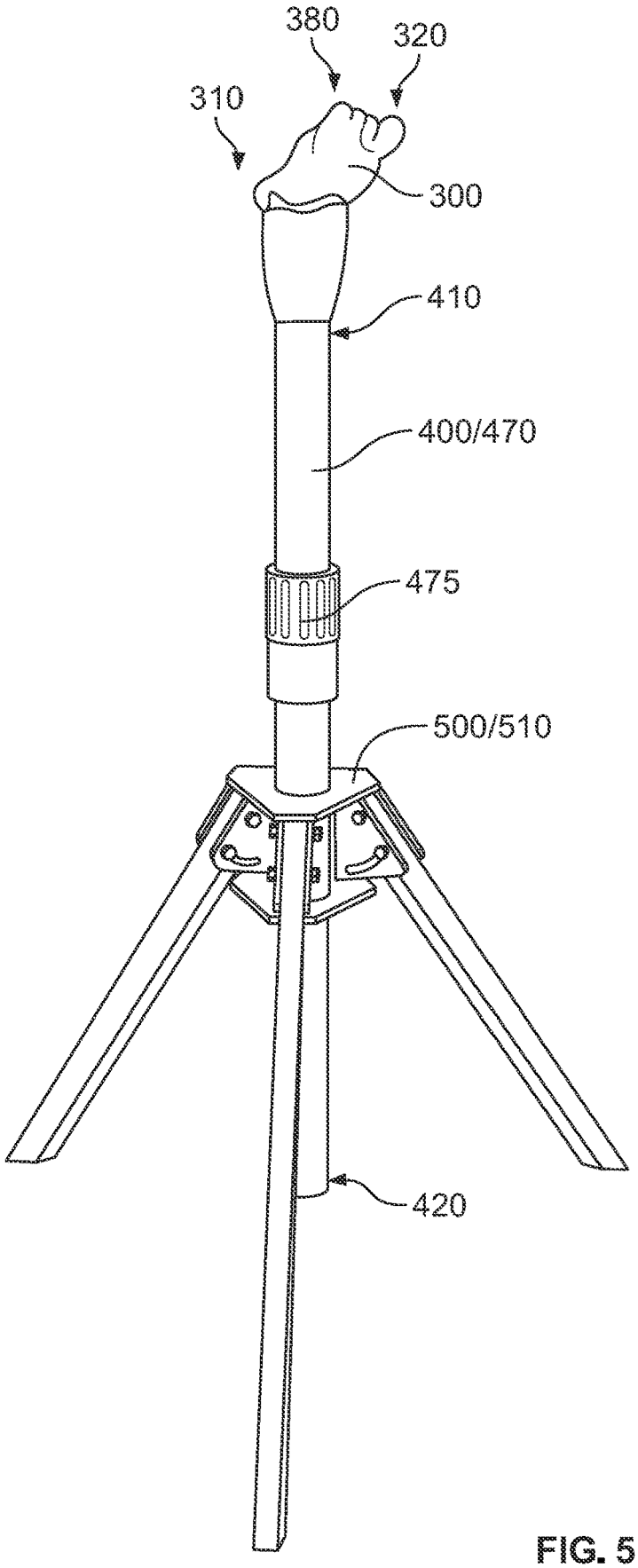
FIG. 5 shows a perspective view of the Sock Joining Device (200), with a volume (300) joined to a telescoping pole (470), the volume (300) in the shape of a foot.

Other types of volume shapes that substantially taper from the second end (620) of the volume (300) towards the first end (610) of the volume (300) can be utilized. For example animal body and head shapes such as an alligator head, a fox head, a tapir head, and a duck bill can be utilized. Inanimate shapes such an arrow, a bullet, a tooth or a lamp shade can be utilized. Body parts such as a foot (380) and an extended hand can be utilized. FIG. 5 shows a perspective view of the Sock Joining Device (200), with a volume (300) joined to a telescoping pole (470), the volume (300) in the shape of a foot (380).

2 The Pole (400)

The pole (400) is joined to the volume (300). The pole (400) comprises a first end (410), a second end (420), and a central axis (490). The first end (410) of the pole (400) is joined to the first end (310) of the volume (300). The first end (410) of the pole (400) is joined to the first end (310) of the volume (300). FIG. 5 shows the first end (410) of the pole (400) is joined to the first end (310) of the volume (300).

When the central axis (390) of the volume (300) intersects the central axis (490) of the pole (400), the central axis (390) of the volume (300) and the central axis (490) of the pole (400) form an angle β. FIG. 3 shows how angle β is measured when the central axis (390) of the volume (300) intersects the central axis (490) of the pole (400).

When the pole (400) and the volume (400) are joined off-center, so that the central axis (390) of the volume (300) does not intersect the central axis (490) of the pole (400), the angle β formed by the central axis of the volume and the central axis of the pole is defined by the formula $\vec{p}\cdot\vec{q}=|\vec{p}||\vec{q}|\cos\beta$ where $\vec{p}$ is the vector formed by the central axis (390) of the volume (300) and $\vec{q}$ is the vector formed by the central axis (490) of the pole (400)

Figure 8:
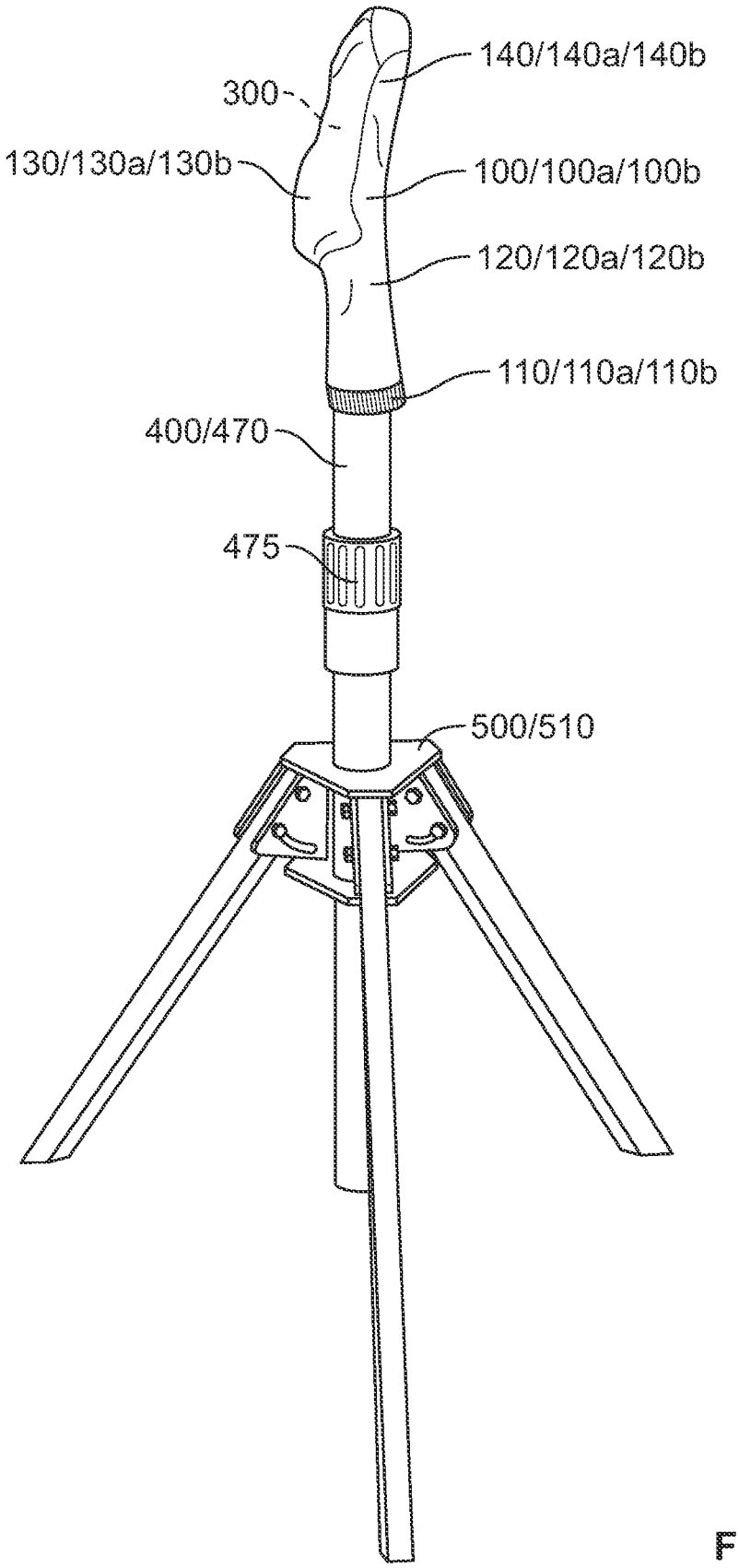
FIG. 8 shows a perspective view of the Sock Joining Device (200), where the leg section (120*a*) of the sock (100*a*) covers the pole (400) and the toe section (140*a*) of the first sock (100*a*) rest over the volume (300).

In order for the Sock Joining Device (200) to fit heel socks, the angle β needs to be between and inclusive of 90 and 270 degrees, preferably an amount that is similar to the angle of heel socks. When the angle β is between 90 and 270 degrees, it forces the insertion of the sock (100) onto the Sock Joining Device (200) with a downward motion. When the sock (100) is fully inserted into the Sock Joining Device (200), the leg section (120) of the sock (100) covers the volume (300), the toe section of the sock (100) covers the pole (400) and the angle β allows the sock to be fully inserted without any bunching or scrunching. FIG. 8 shows a sock (100) inserted onto the Sock Joining Device (200). This lack of bunching or scrunching allows for an efficient and improved fit between the inserted first sock (100*a*) and the inserted second sock (100*b*).

Figure 6:
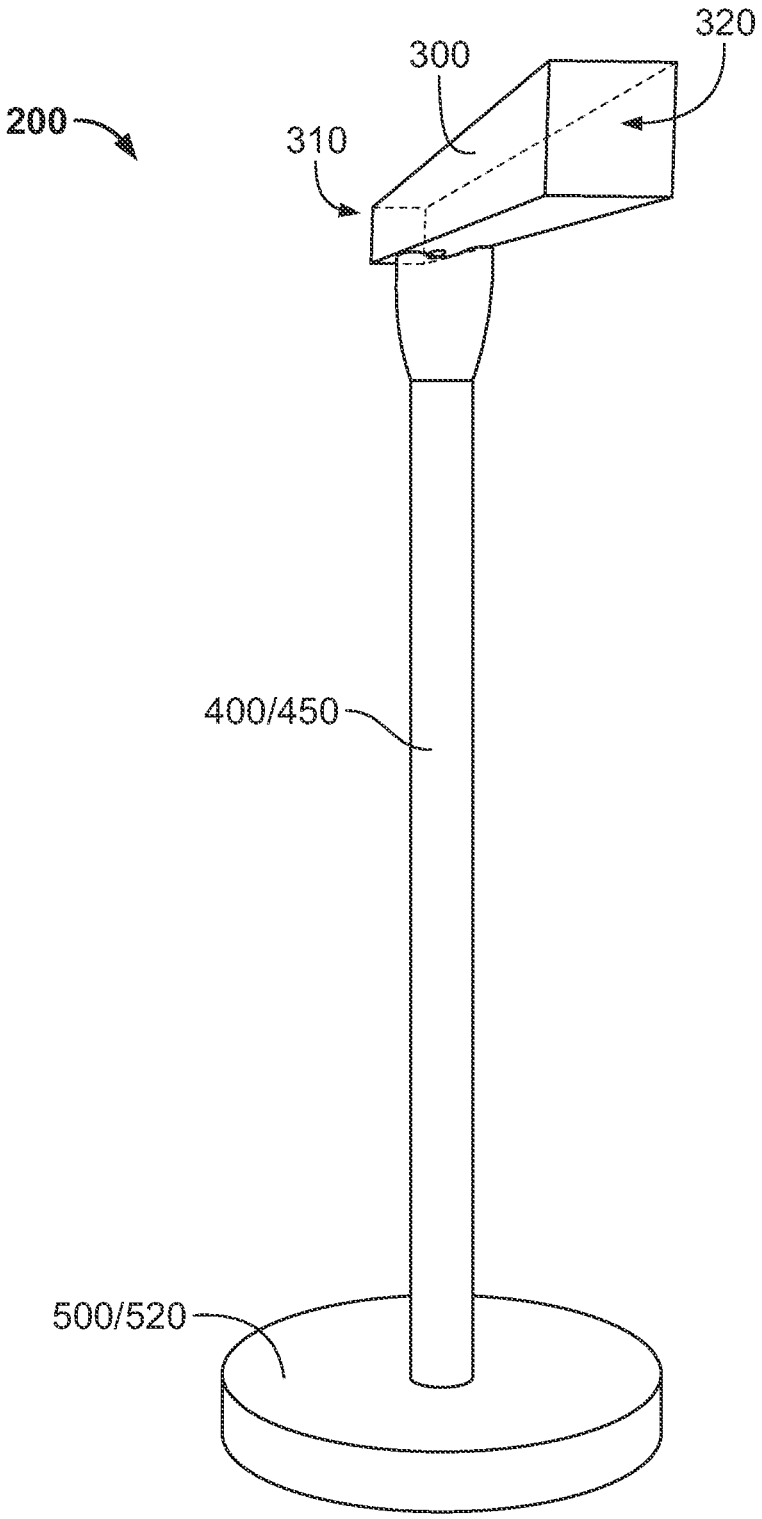
FIG. 6 shows a perspective view of the Sock Joining Device (200), with the pole (400) secured to the means for holding upright the pole (500), specifically a platform that fits a pole (520).

The pole (400) may be a non telescoping pole (450) or a telescoping pole (470). The height of the non telescoping pole (450) does not change and it is a fixed one piece pole segment. FIG. 6 shows a non telescoping pole (450) joined to the volume (300).

A telescoping pole (470) allows the height of the pole (400) to be adjusted to account for different sock sizes as it comprises two or more pole segments. The telescoping pole (470) may further comprise a means for locking the telescoping pole (475). FIG. 1 shows a telescoping pole (470) joined to the volume (300).

The means for locking the telescoping pole (475) allows the two or more pole segments to become rigidly locked together against relative longitudinal displacement. The means for locking the telescoping pole (475) can be any state of the art locking mechanisms utilized to lock telescoping poles, rods, and tubes. These locking mechanisms include clutch locks, split collar locks, snap locks, snap and spring button locks, cam locks, spring button locks, spring button clutch locks, snap lock, set knob lock, mini-economy lock, swaging, retaining pins, knurled screw, among others. See generally https://www.testriteoem.com. FIG. 1 shows a means for locking the telescoping pole (475) as a clutch lock.

3 Means for Holding Upright the Pole (500)

The means for holding upright the pole (500) provides mechanical support to the pole (400), keeping the pole (400) upright as socks (100) are inserted through the volume (300) of the Sock Joining Device (200). The pole (400) is secured to the means for holding upright the pole (500).

Figure 2:
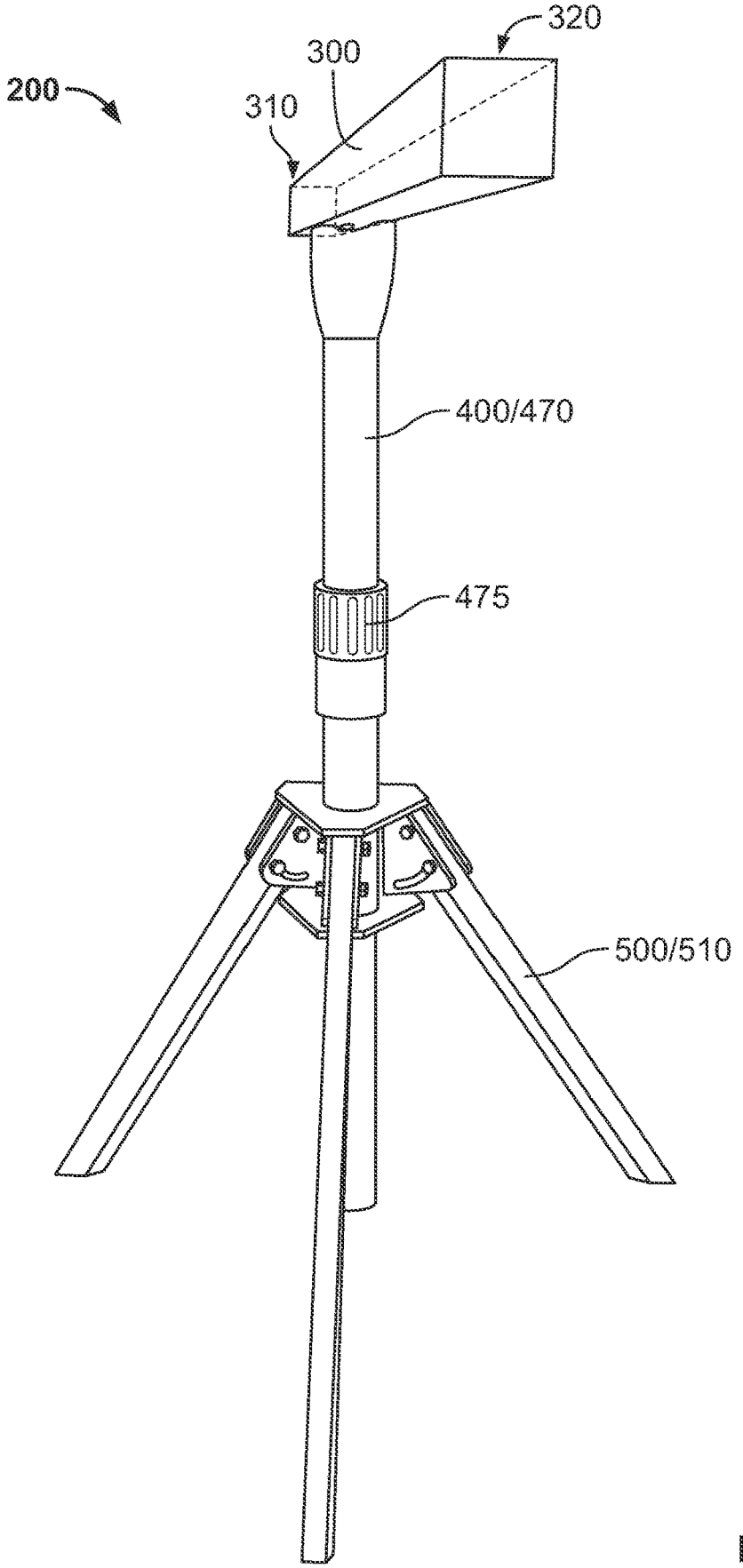
FIG. 2 shows a perspective view of the Sock Joining Device (200), with the pole (400) secured to the means for holding upright the pole (500), specifically a tripod (510).
Figure 4:
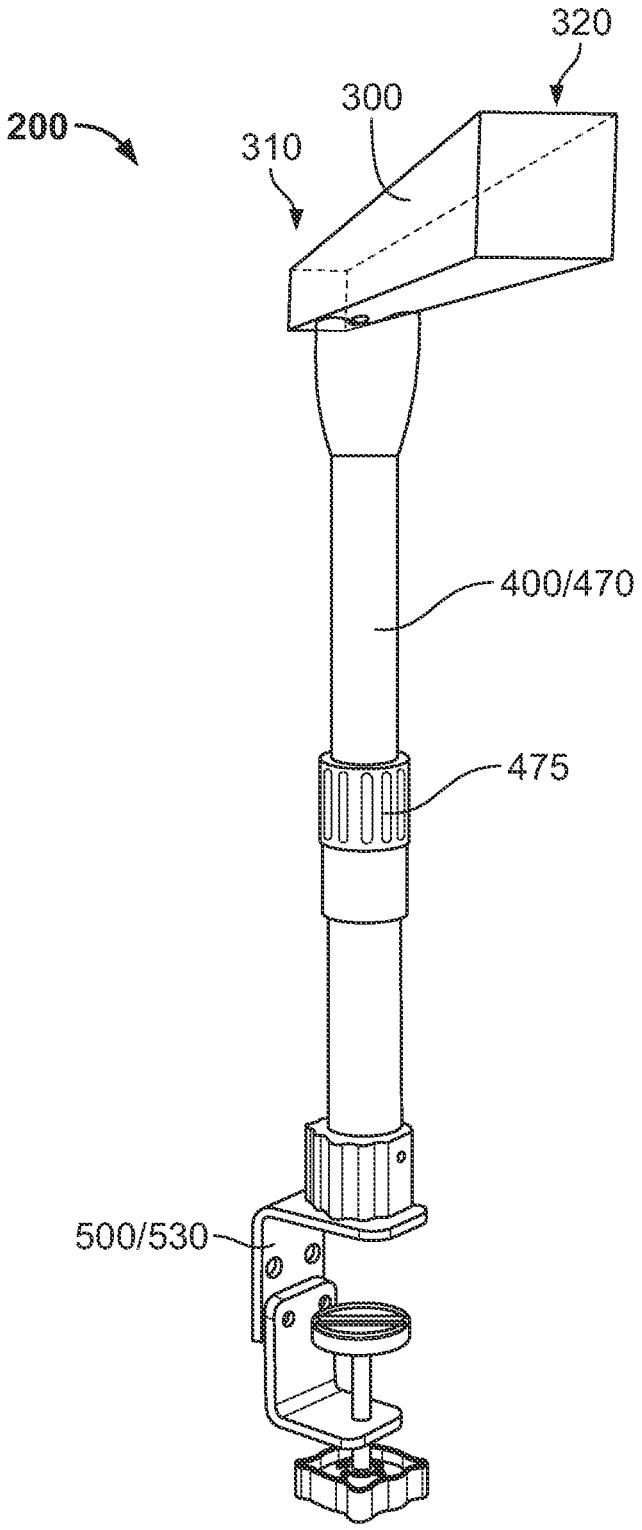
FIG. 4 shows a perspective view of the Sock Joining Device (200), with the pole (400) secured to the means for holding upright the pole (500), specifically a clamp (530).

The means for holding upright the pole (500) can be any state of the art structure that allows mechanical support of the pole (400) to maintain the pole (400) upright while the Sock Joining Device (200) is being utilized. These structures also prevent the Sock Joining Device (200) from sliding around. Sample structures include a tripod (510), a platform that fits a pole (520), and a clamp (530). FIG. 2 shows the means for holding upright the pole (500) as a tripod (510). FIG. 4 shows the means for holding upright the pole (500) as a clamp (530). FIG. 6 shows the means for holding upright the pole (500) as a platform that fits a pole (520).

4 Set Up of Sock Joining Device (200)

The Sock Joining Device (200) needs mechanical support so that the pole (400) is kept upright as socks (100) are inserted through the volume (300) of the Sock Joining Device (200). In its most basic configuration, the pole (400) of the Sock Joining Device (200) is secured to any surface that allows the Sock Joining Device (200) to be held upright such as clothes baskets, drawers, and door jams.

If the Sock Joining Device (200) comprises a means for holding upright the pole (500), the means for holding upright the pole (500) provides mechanical support so that the pole (400) is kept upright as socks (100) are inserted through the volume (300) of the Sock Joining Device (200). The Sock Joining Device (200) is secured over a surface (600). In some Means for holding upright the pole (500) embodiments, such as a tripod (510) or a platform that fits a pole (520), gravity secures the means for holding upright the pole (500). In other Means for holding upright the pole (500) embodiments, such as a clamp (530), the clamp (530) allows for mechanical securing over the surface (600).

5 Usage of Sock Joining Device (200)

Figure 7:
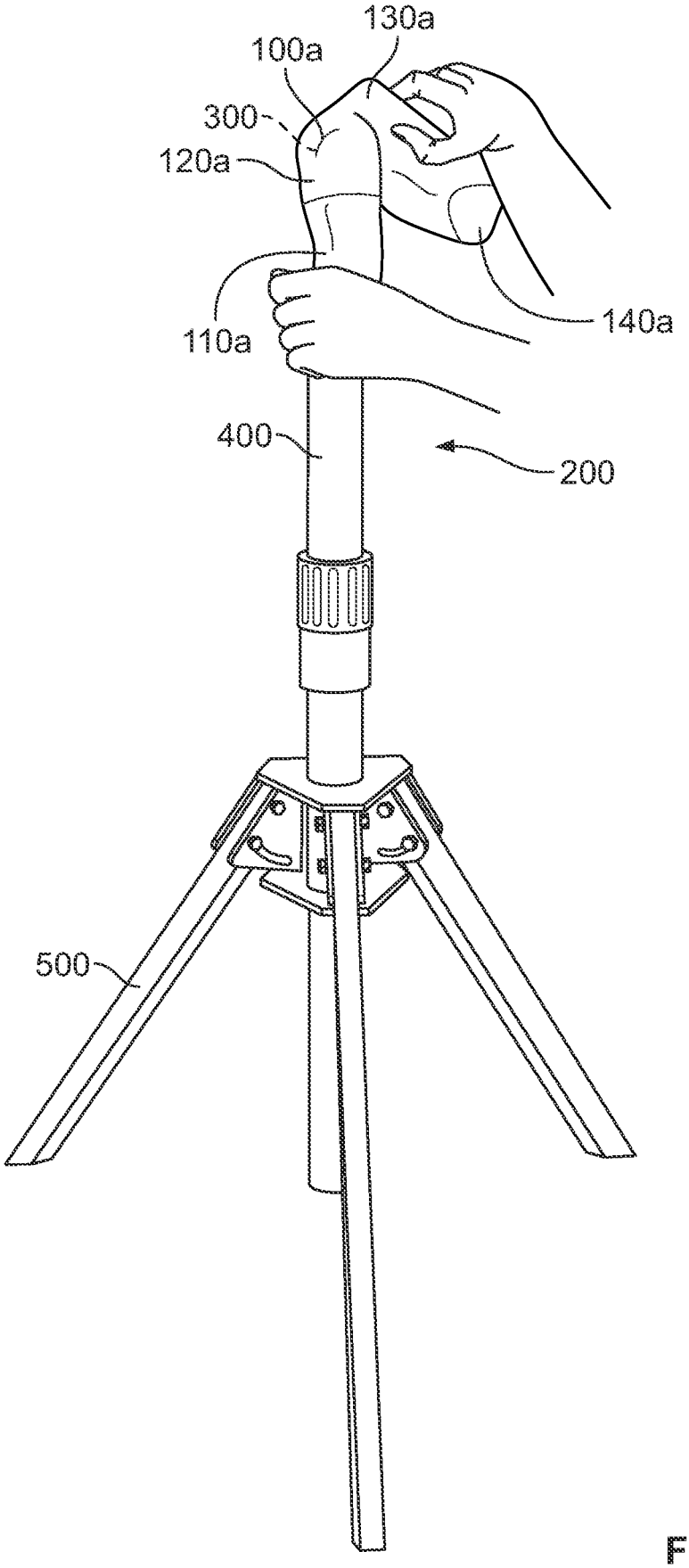
FIG. 7 shows a perspective view of the Sock Joining Device (200), where the cuff (110*a*) of the first sock (100*a*) is inserted past the second end (320) of the volume (300).

To utilize the Sock Joining Device (200), a first sock (100*a*) is inserted to the volume (300) by pulling the cuff (110*a*) of the first sock (100*a*) over the second end (320) of the volume (300). The cuff (110*a*) of the first sock (100*a*) is then moved past the first end (310) of the volume (300) so that the leg section (120*a*) covers the pole (400) and the toe section (140*a*) of the first sock (100*a*) covers the volume (300). The heel section (130*a*) of the first sock (100*a*) rests over the second end (320) of the volume (300). FIG. 7 shows a perspective view of the Sock Joining Device (200), where the cuff (110*a*) of the first sock (100*a*) is inserted past the second end (320) of the volume (300).

The angle β formed by the central axis of the volume (300) intersecting the central axis (490) of the pole (400) ensures that the first sock (100*a*) does not bunch or scrunch, as the angle β is substantially the same as the angle that is formed between of the leg section (120) of the sock (100) and the toe section (140) of the sock (100). FIG. 3 shows the volume (300) oriented relative to the pole (400) so that the angle β is between 90 and 180 degrees.

Figure 9:
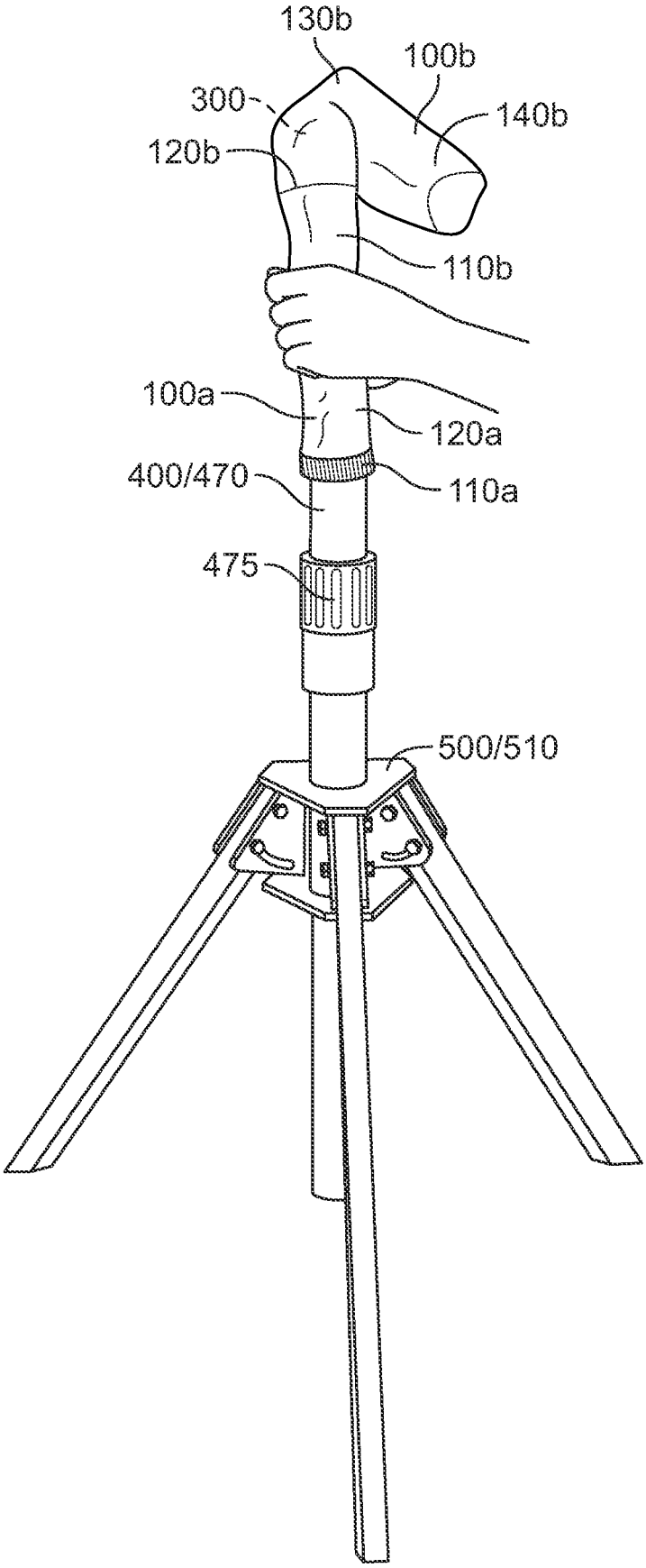
FIG. 9 shows a perspective view of the Sock Joining Device (200), where the cuff (110*b*) of the second sock (100*b*) is then inserted past the second end (320) of the volume (300) so that the leg section (120*b*) of the second sock (100*b*) covers the pole (400) and the leg section (120*a*) of the first sock (100*a*).

A second sock (100*b*) is inserted to the volume (300) over the first sock (100*a*) by pulling the cuff (110*b*) of the second sock (100*b*) over the second end (320) of the volume (300) and the toe section (140*a*) of the first sock (100*a*). The cuff (110*b*) of the second sock (100*b*) is then moved past the first end (310) of the volume (300) so that the leg section (120*b*) of the second sock (100*b*) covers the pole (400) and the leg section (120*a*) of the first sock (100*a*). FIG. 9 shows the cuff (110*b*) of the second sock (100*b*) being inserted over the first sock (100*a*) and the volume (300).

The toe section (140*b*) of the second sock (100*b*) rest over the volume (300) and the toe section (140*a*) of the first sock (100*a*). The heel section (130*b*) of the second sock (100*b*) rests over the heel section (130*a*) of the first sock (100*a*) and the second end (320) of the volume (300). The first sock (100*a*) and the second sock (100*b*) are now "paired socks."

There are least two ways to remove the paired socks from the Sock Joining Device (200). The first manner involves pulling the paired socks by the toe section (140*b*) of the second sock (100*b*) and the toe section (140*a*) of the first sock (100*a*).

The second manner involves folding over the cuff (110*a*) of the first sock (100*a*) and the cuff (110*b*) of the second sock (100*b*) and pulling the two cuffs (110*a*, 110*b*) past the leg section (120*a*) of the first sock (100*a*) and the leg section (120*b*) of the second sock (100*b*). The friction resistance provided by the second end (320) of the volume (300) against the inside surface (180*a*) of the first sock (100*a*) and the inside surface (180*b*) of the second sock (100*b*) prevents the first inserted sock (100*a*) and the second inserted sock (100*b*) from moving as the cuff (110*a*) of the first sock (100*a*) and the cuff (110*b*) of the second sock (100*b*) are pulled past the heel section (130*a*, 130*b*).

Once the cuff (110*a*) of the first sock (100*a*) and the cuff (110*b*) of the second sock are pulled past the toe section (140*a*) of the first sock (100*a*) and the toe section (140*b*) of the second sock (100*b*), the friction resistance provided by the second end (320) of the volume (300) is over-come and the paired socks are released from the Sock Joining Device (200). The second manner joins and folds the paired socks, creating a more compact structure.

The choice between the first manner and the second manner are determined by personal choice of the user of the Sock Joining Device (200).

6 CLARIFYING COMMENTS

While the foregoing written description of the invention enables a person having ordinary skill in the art to make and use what is considered presently to be the best mode thereof, those of ordinary skill in the art will understand and appreciate the existence of variations, combinations, and equivalents of the specific embodiment, process, and examples herein. The invention should therefore not be limited by the above described embodiment, process, and examples, but by all embodiments and processes within the scope and spirit of the invention.

The inventions shown and described herein may be used to address one or more of such problems or other problems not set out herein and/or which are only understood or appreciated at a later time. The future may also bring to light currently unknown or unrecognized benefits which may be appreciated, or more fully appreciated, in association with the inventions shown and described herein. The desires and expected benefits explained herein are not admissions that others have recognized such prior needs, since invention and discovery are both inventive under the law and may relate to the inventions described herein.

I claim:

1. A sock joining device, the sock joining device comprising:

(a) a volume, the volume comprising:
  (i) a central axis;
  (ii) a first end;
  (iii) a second end;
  (iv) where the volume tapers from the second end of the volume towards the first end of the volume;

(b) a pole, the pole comprising of:
  (i) a first end;
  (ii) a second end; and
  (iii) a central axis; and (c) a means for holding upright the pole;

(d) where the second end of the volume is joined to the first end of the pole, (e) where the angle formed by the central axis of the volume and the central axis of the pole is between and inclusive of 110 and 130 degrees, (f) wherein the pole is telescoping, (g) where the second end of the pole is fastened to the means for holding upright the pole;

(h) where the means for holding upright the pole is placed over a surface;

(i) wherein the pole comprises a means for locking the telescoping pole, (j) wherein the volume is in a three dimensional shape of a foot.

2. A sock joining device, the sock joining device comprising:

(a) a volume, the volume comprising:

(i) a central axis;

(ii) a first end;

(iii) a second end;

(iv) where the volume tapers from the second end of the volume towards the first end of the volume;

(b) a pole, the pole comprising of:

(i) a first end;

(ii) a second end; and (iii) a central axis;

(c) a tripod;

(d) where the second end of the volume is joined to the first end of the pole, (e) where the angle formed by the central axis of the volume and the central axis of the pole is between and inclusive of 110 and 130, (f) where the second end of the pole is fastened to the tripod.

3. The sock joining device described in claim 2, (a) wherein the volume is in a three dimensional shape of a foot.

4. The sock joining device described in claim 3, (a) wherein the pole is telescoping.

5. The sock joining device described in claim 4, (a) wherein the pole comprises a means for locking the telescoping pole.

* * * * *